United States Patent [19]

Ito et al.

[11] 4,285,677

[45] Aug. 25, 1981

[54] METHOD AND APPARATUS FOR THE MANUFACTURE OF CIGARETTE FILTERS CONTAINING PARTICULATE MATERIAL

[75] Inventors: Akira Ito, Tokyo; Katsuharu Arisaka, Sakai, both of Japan

[73] Assignee: Daicel Ltd., Osaka, Japan

[21] Appl. No.: 73,491

[22] Filed: Sep. 7, 1979

[51] Int. Cl.[3] ..... A24C 5/50

[52] U.S. Cl. ..... 493/43; 493/47

[58] Field of Search ..... 93/1 C, 77 FT; 131/265, 131/266, 264, 261 A, 261 B; 493/43, 42, 47, 46, 49

[56] References Cited

U.S. PATENT DOCUMENTS

| | | | |
|---|---|---|---|
| T860,013 | 3/1969 | Hawkins et al. | 93/1 C |
| 3,837,264 | 9/1974 | Sexstone | 93/1 C |
| 3,844,200 | 10/1974 | Sexstone | 93/1 C |
| 3,847,064 | 11/1974 | Berger | 93/77 FT X |
| 3,884,741 | 5/1975 | Sexstone | 93/1 C X |
| 3,943,832 | 3/1976 | Sexstone | 93/1 C |
| 4,059,043 | 11/1977 | Berger | 93/77 FT X |

*Primary Examiner*—James F. Coan

*Attorney, Agent, or Firm*—McAulay, Fields, Fisher, Goldstein & Nissen

[57] ABSTRACT

Method and apparatus for the manufacture of cigarette filters containing particulate material. Filter material composed of cellulose acetate tow is fed in the axial direction through a gap defined between a first pair of rolls so that the transverse cross-section of the filter material is changed to a substantially oval shape. The filter material is then fed through another gap defined between a second pair of rolls so that the transverse cross-section of the filter material is further changed to a substantially heart shape and at the same time providing pockets at axially spaced positions. Particulate material is deposited in said pockets. The filter material is closed so that the deposited particulate material is positioned in the interior of the filter material and wrapped with wrapping sheets.

6 Claims, 8 Drawing Figures

METHOD AND APPARATUS FOR THE MANUFACTURE OF CIGARETTE FILTERS CONTAINING PARTICULATE MATERIAL

BACKGROUND OF THE INVENTION

1. Field of the Invention

This invention relates to a method and an apparatus for the manufacture of filter plugs which are used for and connected to cigarettes.

More particularly, this invention relates to a method and an apparatus for the manufacture of such filter plugs from a formed filter rod of a material such as cellulose acetate by providing axially spaced pockets in the interior of the rod, depositing particulate material therein and cutting the rod between said deposits to provide individual filter plugs each having cores of particulate material.

2. Description of the Prior Arts

Up to the present time, some methods and apparatuses for the manufacture of such filter plugs mentioned above have been proposed.

In U.S. Pat. No. 3,844,200, filter plugs are manufactured by continuously feeding a fibrous filter material in the axial direction, expanding the filter material to make the cross section thereof to be substantially U-shape, depositing particulate material at constant axial intervals, rolling the filter material in a circular column and wrapping the filter material with suitable wrapping material. The device for depositing particulate material comprises a wheel having pockets arranged on the peripheral edge thereof at predetermined spaces, each pocket having a predetermined volume. The wheel is rotated at a speed corresponding to the travelling speed of the filter material. Each pocket receives particulate material from a hopper when it reaches the uppermost position, and deposits the particulate material on the bottom portion of the U-shaped filter material when it is downwardly directed. According to this known method, the filter material is not adhered between cellulose acetate filaments thereof while the filter material is spreaded in substantially U-shaped cross section. Therefore, if any variations in mechanical conditions are occurred within the filter material before the filter material is fed to the apparatus through a trumpet guide, the density of the filter material may be changed in the axial and transverse direction thereof, the positions of particulate material may be changed with regard to the width of the filter material so that the particulate material is biased in the interior of the filter material, and/or the particulate material may be dropped from cut edges when the filter material is cut to the individual filter plugs.

In U.S. Pat. No. 3,943,832, a plain plate-like filter material is deformed to a substantially U-shaped channel by a special guide means, so that the variations of the density of particulate material in the transverse direction are eliminated. However, there are no provisions for fixing the particulate material being deposited in the channel and spaced in the longitudinal axial direction. The instability of the positions of the particulate material is not solved.

In U.S. Pat. No. 3,884,741 and U.S. Pat. No. 3,957,563, there is provided a means for eliminating the unevenness of the distribution of particulate material in the axial and transverse directions of the filter material. That is to say, the method is characterized by providing a filter rod of filtering material having a longitudinal axis and cutting the rod in the direction of the axis, exposing the interior of the rod, providing pockets at axially spaced intervals in the interior of the rod, depositing particulate material therein and closing and sealing the rod. However, in this U.S. Patent, there are no disclosures concerning methods for supplying the rod-like filter material to a forming machine. A wind up machine for the filter material known in the prior art may be used and a continuous rod-like filter material may be supplied directly to the apparatus for manufacturing filter rods containing particulate material without a last cutting step. In this case, the rod-like filter material must be cut in the axial direction immediately after having been wound. Such a rod-like filter material is not fully adhered between cellulose filaments thereof because a sufficient time has not been passed after the rod-like filter material was plastisized. Therefore, the rod-like filter material may be expanded due to the repelment of the interior cellulose filaments, so that it is difficult to obtain desired pockets in which particulate material is deposited.

SUMMARY OF THE INVENTION

Accordingly, it is a primary object of the present invention to provide a new and improved method and an apparatus for the manufacture of filter plugs containing particulate material in which the aforementioned difficulties in the prior arts are eliminated.

A further object of the present invention is to provide a new and improved method and an apparatus in which the particulate material is accurately deposited in desired positions in the interior of the filter material.

Another object of the present invention is to provide such a method and an apparatus in which the particulate material deposited in the interior of the filter material is stabilized in positions.

Still another object of the present invention is to provide such a method and an apparatus in which manufacturing steps from plasticization of filter material through deposition of particulate material may be quickly and effectively carried out.

In accordance with the present invention, there is provided a method for the manufacture of cigarette filters containing particulate material, comprising the steps of: plasticizing a filter material composed of thermoplasticity filaments with plasticizer and converging said filter material; continuously feeding said filter material in the axial direction; pressing said filter material in the axial direction so as to make the transverse cross section thereof to be a substantially oval shape; pressing said filter material toward the interior thereof along the shorter diameter of said substantially oval cross section so that the transverse cross section of said filter material is changed to a shape wherein two campaniforms are arranged symmetrically and connected to each other; providing pockets at axially spaced positions on said pressed surface of said filter material; depositing particulate material in said pockets; feeding and closing said filter material so that the deposited particulate is positioned in the interior of said filter materials; and, wrapping said filter material with wrapping sheets.

In accordance with the present invention, there is also provided an apparatus for the manufacture of cigarette filters containing particulate material, from plasticized filter material composed of thermoplasticity filaments, comprising: a first pair of rolls, between which a first gap is defined, said gap having a substantially oval cross section, said filter material being fed through said first gap and being formed so that the transverse cross section thereof is changed to a substantially oval shape; a second pair of rolls, between which a second gap is defined, said gap having a cross section wherein two campaniforms are arranged symmetrically and connected to each other, one of said second pair of rolls having projections on the peripheral edge thereof for forming pockets, said filter material being fed through said second gap and being formed so that the transverse cross section thereof is changed to a shape wherein two campaniforms are arranged symmetrically and connected to each other and at the same time pockets are formed on the surface of said filter material; means for depositing particulate material in said pockets; means for holding and closing said filter material so that the deposited particulate material is positioned in the interior of said filter material; and, means for wrapping said filter material with wrapping sheets.

BRIEF DESCRIPTION OF THE DRAWINGS

The objects and construction of the present invention will be readily evident from the following description and the accompanying drawings wherein.

DESCRIPTION OF THE PREFERRED EMBODIMENT

Figure 1:
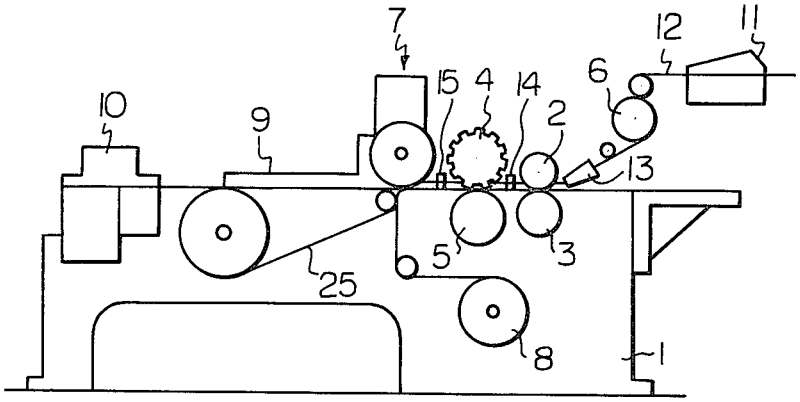
FIG. 1 is a schematic illustration of an apparatus for the manufacture of cigarette filters of the present invention.

Referring now to FIG. 1 of the drawings, there are mounted on a common table 1 a pair of first rolls 2 and 3, a pair of second rolls 4 and 5, a filter material supply device 6 and a particulate material supply device 7. Reference numeral 8 indicates a supply of sheet material for wrapping filter plugs, 10 indicates a device for cutting filter plugs at a constant length, and 12 indicates a web of fibrous cellulose acetate tow, hereinafter referred to simply as a filter material. Reference numeral 11 indicates a conventionally known plasticizer supplying device by which the filter material is plasticized.

Figure 2:
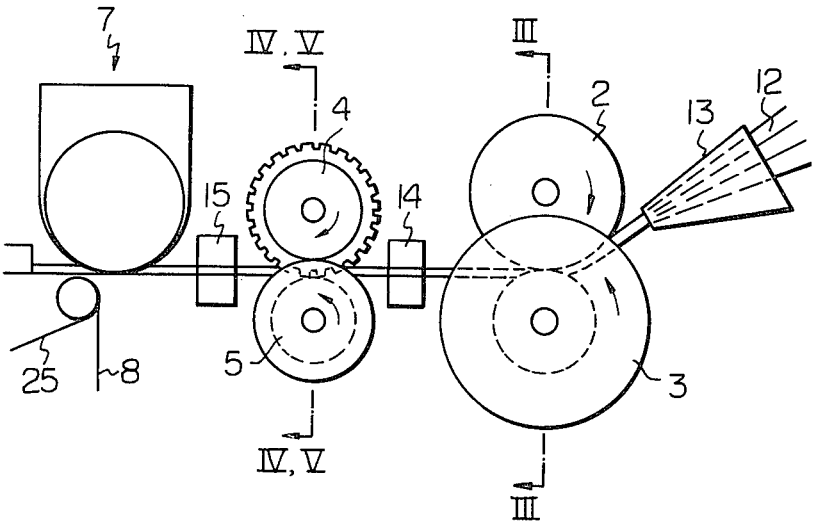
FIG. 2 is a partial enlarged view illustrating the principal parts of the apparatus illustrated in FIG. 1.
Figure 3:
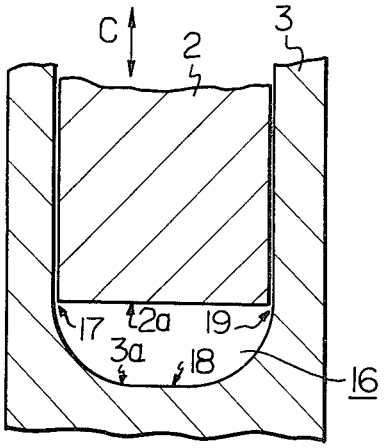
FIG. 3 is a partial cross-sectional view of a first pair of rolls.

Referring to FIGS. 2, 3, 4 and 5, the first pair of rolls 2 and 3 comprise a circular roll 2 having an outer peripheral surface 2*a* parallel to the axis thereof around which the roll 2 rotates and a circular roll 3 having an annular peripheral recess 3*a* hollowed inwardly from the outer peripheral edge thereof. When the first pair of rolls 2 and 3 are combined and assembled, a gap 16 having a substantially oval cross-section is defined therebetween, as illustrated in FIG. 3. The filter material is fed into the gap 16 and pressed between the peripheral surface 2*a* of the roll 2 and the annular recess 3*a* of the roll 3 so that the cross-section of the filter material is changed to a substantially oval shape.

Figure 4:
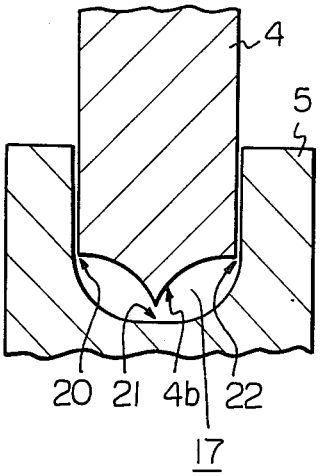
FIG. 4 is a partial cross-sectional view of a second pair of rolls taken along a cross-section on which there is no pocket forming projection.
Figure 5:
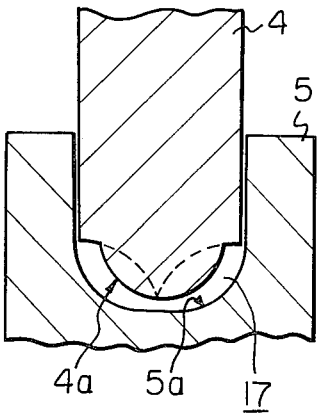
FIG. 5 is a partial cross-sectional view of a second pair of rolls taken along a cross-section on which there is a pocket forming projection.

The second pair of rolls 4 and 5 comprise a circular roll 4 and a circular roll 5, as illustrated in FIGS. 4 and 5. The circular roll 4 has a projecting ridge 4*b*, as illustrated in FIG. 4, which is formed along the peripheral direction on a center portion of the outer peripheral surface thereof and projections 4*a* for forming pockets, as illustrated in FIG. 5, which are formed at predetermined intervals on the same outer peripheral surface thereof. The circular roll 5 has an annular peripheral recess 5*a* hollowed inwardly from the outer peripheral edge thereof. When the second pair of rolls 4 and 5 are combined and assembled, a gap 17 is defined therebetween, which gap has a substantially heart shape cross-section. More particularly, the gap 17 has a cross-section the shape of which is formed by two campaniforms arranged symmetrically and connected to each other. FIG. 4 illustrates a cross-sectional view of the gap 17 defined between the second pair of rolls 4 and 5 taken along a cross-section on which there is no pocket forming projection. FIG. 5 illustrates a cross-sectional view of the same gap 17 taken along a cross-section on which there is one of the pocket forming projections 4*a*.

The first pair of rolls 2 and 3 and the second pair of rolls 4 and 5 are heated at a predetermined temperature by any suitable manner known in the prior art and rotated at a predetermined peripheral speed corresponding to the travelling speed of the filter material. The temperature of these rolls is selected to be a constant value in the range of from 100 to 230 degrees centigrade in accordance with the drawing speed of the filter material, the kind and density of the filter material, the kind of plasticizer, and so forth. For instance, if the size of a single fiber is 3.3 denier, if the size of the filter material is 40,000 denier and if the drawing speed of the filter material is 80 meters per minute, it is desirable that the temperature of the rolls be about 150 degrees centigrade.

The operation of the apparatus of the present invention will now be described. In FIGS. 1 and 2, the filter material 12, opened by any suitable opening machine known in the prior art, is fed into the plasticizer supplying device 11 and is plasticized by adding thereto any suitable plasticizing material. The filter material is then fed into a trumpet guide 13 by which the filter material is converged from a flat condition having a width of about 30 centimeters to a cylindrical condition having a diameter of about 2 centimeters. The filter material is then fed into the gap 16 (FIG. 3) between the first pair of rolls 2 and 3, by which the filter material is formed so that the cross-section thereof is changed to an oval shape. The surface of the filter material which comes into contact with the first pair of rolls 2 and 3 is melted by the heat of the latters. However, since the time during which the filter material comes into contact with the first pair of rolls is short, the inside filaments of the filter material are not completely melted, but tend to expand toward the melted outer surface fibrous layer due to the reaction force of the inside filaments after the filter material passes through the first pair of rolls 2 and 3. The filter material is cooled immediately after having been drawn from the first pair of rolls 2 and 3, so that the melted fibrous layer is fixed or stabilized and the filter material maintains its substantially oval cross-section.

Figure 8:
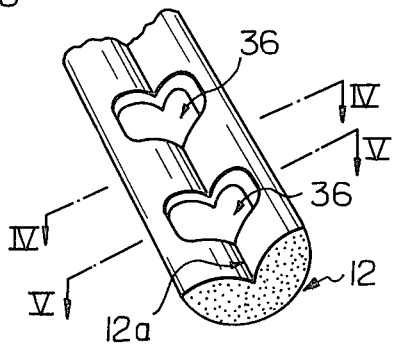

The filter material is then fed into the gap 17 between the second pair of rolls 4 and 5 illustrated in FIGS. 4 and 5, where the filter material having its oval cross-section is pressed downwardly from the upper surface thereof along the shorter diameter thereof toward the center portion thereof by the projecting ridge 4*b* of the roll 4, so that the cross-section of the filter material is changed to a heart shape, more particularly a shape wherein two campaniforms are arranged symmetrically and connected to each other. At the same time, pocket holls 36 (FIG. 8) are formed on the upper surface of the filter material at predetermined constant intervals in the longitudinal direction of the filter material by the pocket forming projections 4*a* of the roll 4. After the filter material is treated by the second pair of rolls 4 and 5, the appearance thereof is as illustrated by the perspective view in FIG. 8. The portion of the filter material taken along line IV—IV in FIG. 8, wherein no pocket holls are formed, treated by a portion of the second pair of rolls 4 and 5 illustrated in FIG. 4. The portion of the filter material taken along line V—V in FIG. 8, wherein a pocket holl 36 is formed by the pocket forming projections 4*a* of the roll 4, is treated by a portion of the second pair of rolls 4 and 5 illustrated in FIG. 5.

In order to prevent the filter material from forming cracks or plaits while it passes through the first and second pairs of rolls, the width 17-18-19 (FIG. 3) of the gap between the first pair of rolls 2 and 3 is preferably the same as the width 20-21-22 (FIG. 4) of the gap between the second pair of rolls 4 and 5. The width of the gap 16 (FIG. 3) between the first pair of rolls 2 and 3 is also preferably adjustable in the vertical direction.

In FIG. 1, having been formed by the second pair of rolls 4 and 5, the filter material is cooled by a cooling device 15, in the same manner as mentioned above, so that the filter material is stabilized and fixed. The filter material is then fed to the particulate material supply device 7. The particulate material supply device 7, which is known in itself in the prior art, operates at a speed corresponding to the travelling speed of the filter material and deposits particulate material in each pocket holl 36 (FIG. 8), formed as mentioned above, at a constant time interval and at a constant volume thereof. Then, the filter material, having its cross-section wherein two campaniforms are arranged symmetrically and connected to each other, is folded about a center connecting portion 12*a* (FIG. 8) in the longitudinal direction so that the shape of the filter material is changed to a shape of circular rod. The rod and sheet material 8 are fed into a wrapping device 9, where the filter material is wrapped with an endless tape 25 and both edges of the endless tape are adhered to each other in the axial direction by any suitable adhesion so that a rod-like filter plug is formed. The filter plug is then fed to the cutting device 10 where the filter plug is cut at axially spaced constant intervals, that is to say, the filter rod is cut so that a pocket holl filled with particulate material is positioned at the center portion of the interior of each cut individual filter tip.

Figure 6:
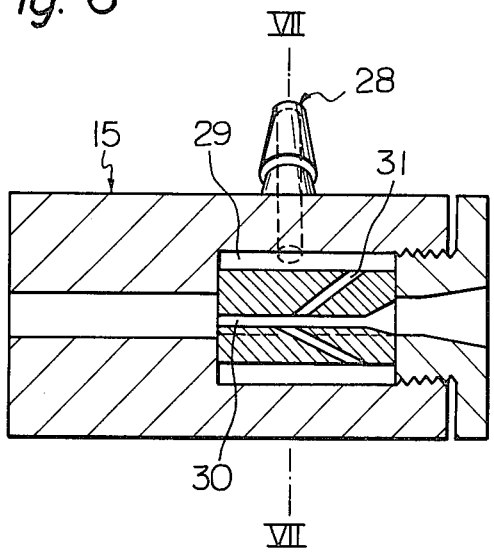
FIG. 6 is a longitudinal cross-sectional view of a cooling device.
Figure 7:
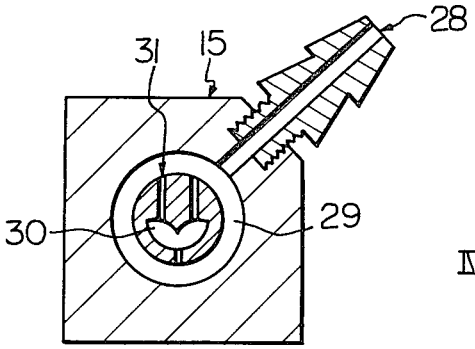
FIG. 7 is a transverse cross-sectional view taken along line VII—VII of FIG. 6; and, FIG. 8 is a perspective view of a filter material which is provided with pockets for receiving the particulate material therein.

FIG. 6 is a longitudinal cross-sectional view of the cooling device 15. FIG. 7 is a cross-sectional view taken along line VII—VII in FIG. 6. While the filter material which has been formed by the second pair of rolls 4 and 5 (FIGS. 4 and 5) passes through a cooling passage 30 of the cooling device 15, the filter material is cooled by compressed air, which is supplied from a nozzle 28 through an annular air chamber 29 and air passages 31 into the cooling passage 30. The filter material which has been formed by the first pair of rolls 2 and 3 (FIG. 3) is also cooled by the cooling device 14 (FIG. 1) which is substantially the same in construction as the cooling device 15 mentioned above, except that the cross section of a passage of the cooling device 14 through which the filter material passes is different from that of the second cooling device 15.

EXAMPLE

The inventors have manufactured cigarette filters containing particulate material according to the present invention under the following conditions and favorable results were obtained. The filter material was acetone solubilization cellulose acetate tow in which the size of a single filament was 3.3 denier and the size of the two was 43,000 denier. The filter material was opened uniformly to a width of about 30 centimeters by means of a known opening machine and was plasticized by adding toriaceton by 9.9 percent weight as the plasticizer. The filter material was then supplied to a first pair of rolls heated to 170 degrees centigrade and having a gap as illustrated in FIG. 3. After having been cooled, the filter material was fed into a second pair of rolls heated to 175 degrees centigrade and having a gap as illustrated in FIGS. 4 and 5. After having been cooled again, the filter material having a shape as illustrated in FIG. 7 was obtained. The pocket holls 36, formed in the manner mentioned above, had a width of 5 mm and a length of 10 mm. The pitch space of the pocket holls in the axial direction was 20 mm. Grannular activated charcoal having a grain size of from 20 to 40 mesh was used as the particulate material. The particulate material of a weight of 120 mg was deposited in each pocket holl 36. The filter rods thus formed were wrapped with paper having a width of 27 mm, and filter plugs having a diameter of 7.9 mm were obtained. The filter plugs were cut along the transverse cross-section thereof at intermediate positions between the respective pockets to obtain individual filter tips.

What we claim is:

1. A method for the manufacture of cigarette filters containing particulate material, comprising the steps of:

plasticizing a filter material composed of thermoplasticity filaments with plasticizer and converging said filter material;

continuously feeding said filter material in the axial direction;

pressing said filter material in the axial direction so as to make the transverse cross-section thereof a substantially oval shape;

pressing said filter material toward the interior thereof along the shorter diameter of said substantially oval cross-section so that the transverse cross-section of said filter material is changed to a shape wherein two campaniforms are arranged symmetrically and connected to each other;

providing pockets at axially spaced positions on said pressed surface of said filter material;

depositing a particulate material in said pockets;

folding and closing said filter material so that the deposited particulate is positioned in the interior of said filter material; and, wrapping said filter material with wrapping sheets.

2. A method as set forth in claim 1, wherein said filter material is fed in the axial direction through a gap defined between a pair of heated rolls whereby the transverse cross section of the filter material is changed to a substantially oval shape.

3. A method as set forth in claim 1, wherein the filter material is fed in the axial direction through a gap defined between a pair of heated rolls, one of said rolls having a projecting ridge along the peripheral edge thereof and projections for forming pockets on the same peripheral edge, whereby the transverse cross-section of said filter material is changed to a shape wherein two campaniforms are arranged symmetrically and connected to each other, and at the same time pockets are formed on the surface of said filter material.

4. A method as set forth in claims 2 or 3, wherein said pair of rolls are heated to within 100 to 230 degrees centigrade.

5. A method as set forth in claims 2 or 3, wherein said filter material is cooled immediately after it passes through said pair of rolls.

6. An apparatus for the manufacture of cigarette filters containing particulate material, from plasticized filter material composed of thermoplastisity filaments, comprising:

a first pair of rolls, between which a first gap is defined, said gap having a substantially oval cross section, said filter material being fed through said first gap and being formed so that the transverse cross-section thereof is changed to a substantially oval shape;

a second pair of rolls, between which a second gap is defined, said gap having a cross-section wherein two campaniforms are arranged symmetrically and connected to each other, one of said second pair of rolls having projections on the peripheral edge thereof for forming pockets, said filter material being fed through said second gap and being formed so that the transverse cross section thereof is changed to a shape wherein two campaniforms are arranged symmetrically and connected to each other and at the same time pockets are formed on the surface of said filter material;

means for depositing particulate material in said pockets;

means for folding and closing said filter material so that the deposited particulate material is positioned in the interior of said filter material; and, means for wrapping said filter material with wrapping sheets.

* * * * *